US006203899B1

(12) United States Patent
Hirose et al.

(10) Patent No.: US 6,203,899 B1
(45) **Date of Patent: *Mar. 20, 2001**

(54) PRINTING MEDIUM, AND INK-JET PRINTING PROCESS AND IMAGE-FORMING PROCESS USING THE SAME

(75) Inventors: Mifune Hirose, Machida; Mamoru Sakaki, Yamato; Masato Katayama, Yokohama; Masahiko Higuma, Togane; Kenichi Moriya; Yuko Nishioka, both of Tokyo, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/615,817

(22) Filed: Mar. 14, 1996

(30) Foreign Application Priority Data

| | | |
|---|---|---|
| Mar. 15, 1995 | (JP) | 7-055760 |
| Jun. 9, 1995 | (JP) | 7-143020 |
| Jun. 9, 1995 | (JP) | 7-143022 |
| Jun. 9, 1995 | (JP) | 7-143024 |
| Jun. 21, 1995 | (JP) | 7-154925 |
| Mar. 11, 1996 | (JP) | 8-053387 |

(51) Int. Cl.[7] ..... B41M 5/00; B41J 2/01

(52) U.S. Cl. ..... 428/341; 347/105; 347/106; 428/328; 428/329; 428/331; 428/342; 428/409; 428/195

(58) Field of Search ..... 428/195, 211, 428/328–331, 537.5, 341, 342, 409; 347/105, 106

(56) References Cited

U.S. PATENT DOCUMENTS

| | | | | |
|---|---|---|---|---|
| 4,440,827 | | 4/1984 | Miyamoto et al. | 428/327 |
| 4,624,985 | * | 11/1986 | Tsutsumi et al. | 427/150 |
| 4,686,118 | | 8/1987 | Arai et al. | 427/261 |
| 4,770,934 | * | 9/1988 | Yamasaki et al. | 428/195 |
| 4,785,313 | | 11/1988 | Higuma et al. | 346/135.1 |
| 4,877,680 | | 10/1989 | Sakaki et al. | 428/332 |
| 4,879,166 | | 11/1989 | Misuda et al. | 428/212 |
| 4,944,988 | | 7/1990 | Yasuda et al. | 428/195 |
| 5,027,131 | | 6/1991 | Hasegawa et al. | 346/1.1 |
| 5,041,328 | * | 8/1991 | Akiya et al. | 428/195 |
| 5,101,218 | | 3/1992 | Sakaki et al. | 346/1.1 |
| 5,120,601 | | 6/1992 | Kotaki et al. | 428/327 |
| 5,182,175 | | 1/1993 | Sakaki et al. | 428/537.5 |
| 5,266,383 | | 11/1993 | Sakaki et al. | 428/195 |
| 5,576,088 | * | 11/1996 | Ogawa et al. | 428/195 |

FOREIGN PATENT DOCUMENTS

| | | | |
|---|---|---|---|
| 2007373 | 7/1990 | (CA) | 428/195 |
| 3151471 | 8/1982 | (DE) | 428/195 |
| 298424A2 | 1/1989 | (EP) . | |
| 379964 | 8/1990 | (EP) | 428/195 |
| 529308A1 | 3/1993 | (EP) . | |
| 3-26665 | 10/1984 | (JP) | 428/195 |
| 5-36237 | 6/1986 | (JP) | 428/195 |
| 63-265680 | 11/1988 | (JP) | 428/195 |
| 6-55829 | 3/1994 | (JP) . | |

* cited by examiner

*Primary Examiner*—Pamela R. Schwartz
(74) *Attorney, Agent, or Firm*—Fitzpatrick, Cella, Harper & Scinto

(57) ABSTRACT

Disclosed herein is a printing medium, comprising a liquid-absorbent base material, an ink-receiving layer provided on the base material, which comprises a pigment, a binder and a cationic substance, and a surface layer provided on the ink-receiving layer composed principally of cationic ultrafine particles as inorganic particles.

51 Claims, 2 Drawing Sheets

PRINTING MEDIUM, AND INK-JET PRINTING PROCESS AND IMAGE-FORMING PROCESS USING THE SAME

BACKGROUND OF THE INVENTION

1. Field of the Invention

The present invention relates to a printing medium which shows excellent printability in printing using water-based inks, in particular, ink-jet printing, has good surface gloss and can provide images having a high optical density, and an ink-jet printing process and an image-forming process using this medium.

The present invention also relates to a printing medium which is suitable for use in forming printed images having not only excellent water fastness and moisture fastness, but also high optical density and resolution and excellent surface gloss, and an image-forming process using this medium.

2. Related Background Art

As printing media used in formation of images by an ink-jet recording system, there have heretofore been used printing paper as described in Japanese Patent Publication No. 3-26665, which comprises a paper substrate and a coating layer provided on the paper substrate and containing finely powdered silica and a water-soluble binder such as polyvinyl alcohol, and glossy paper as described in Japanese Patent Publication No. 5-36237, which comprises an opaque base material such as a synthetic paper web and a film formed on the base material comprising a water-soluble resin as a principal component. Besides, described in Japanese Patent Application Laid-Open No. 63-265680 is cast-coated paper for ink-jet printing, in which a coating layer composed principally of silica and a binder is formed by a casting process.

With the recent improvement in performance of ink-jet printing apparatus, such as speeding up of printing and multi-coloring of images, printing materials for ink-jet are also required to have higher and wider properties for the purpose of providing images which satisfy various properties such as resolution and optical density in a well-balanced relation. Examples of such properties may include the following properties:

(1) ink-absorbing capacity being great, and ink being quickly dried);

(2) providing dots high in optical density and clear in periphery;

(3) providing dots having a substantially round shape and a smooth periphery;

(4) causing no unevenness of color strength at a solid printed area and providing an image having an even color density;

(5) providing an image having definite boundaries without causing bleeding even if inks of different colors are applied in an adjoining relation; and (6) providing an image having good water fastness, moisture fastness and light fastness, and hence being able to stably store the image thereon for a long period of time without deteriorating it.

Various investigations have also been carried out with a view toward forming an image having high resolution and optical density comparable to a silver salt photograph or the like. As a means for achieving the image quality comparable to the silver salt photograph, there is a method of further improving surface glossiness and optical density while retaining printability such as ink absorbency, the ability to fix a coloring material in ink, water fastness of the resulting image, and coloring ability in color printing.

However, the surface of the coated paper described in Japanese Patent Publication No. 3-26665 is mat and hence unfit for an application of which gloss is required. The glossy paper described in Japanese Patent Publication No. 5-36237 can provide an image having high gloss and optical density, but involves a problem that since an ink-receiving layer thereof is a film of a hydrophilic resin, drying and fixing of ink applied to the surface thereof are slow, and so a printed area after printing (after application of the ink) is sticky to the touch for a long period of time, resulting in hindrance to continuous printing. This glossy paper is slow in drying of ink and hence tends to cause migration of ink on the surface thereof, which offers a problem that unevenness of color strength may often occur at a solid printed area. There is further a problem that the resulting image has poor water fastness due to its structure.

On the other hand, the cast-coated paper for ink-jet printing described in Japanese Patent Application Laid-Open No. 63-265680 is good from the viewpoint of absorption and fixing of ink, but involves a problem that the resulting image is insufficient in fastness properties such as water fastness and moisture fastness, or in coloring.

U.S. Pat. No. 4,879,166 discloses a recording sheet having an ink-receiving layer composed of a lower layer containing spherical silica and an upper layer containing pseudoboehmite. Since this sheet is provided with a large amount of a coating layer with a view toward surely imparting sufficient ink absorbency to the ink-receiving layer, the ink-receiving layer becomes brittle and hence offers a problem that dusting occurs to a great extent. Such a sheet is also insufficient from the viewpoint of water fastness and moisture fastness of the resulting image.

SUMMARY OF THE INVENTION

The present invention has been completed with a view toward solving the foregoing problems involved in the prior art, and an object thereof is to provide a printing medium which satisfies the above-described required properties in a well-balanced relation, has a good surface glossiness and permits printing with higher optical density, and an ink-jet printing process and an image-forming process using this printing medium.

Another object of the present invention is to provide a printing medium which is suitable for use in forming images having high optical density, resolution and surface gloss, and moreover excellent water fastness and moisture fastness, and an image-forming process using this printing medium.

The above objects can be achieved by the present invention described below.

According to the present invention, there is thus provided a printing medium, comprising a liquid-absorbent base material, an ink-receiving layer provided on the base material, which comprises a pigment, a binder and a cationic substance, and a surface layer provided on the ink-receiving layer composed principally of cationic ultrafine particles as inorganic particles.

According to the present invention, there is also provided an ink-jet printing process comprising ejecting droplets of inks from ejection orifices of a printing head in response to printing signals to apply the ink droplets to the printing medium described above.

According to the present invention, there is further provided an image-forming process comprising ejecting droplets of inks from ejection orifices of a printing head in response to printing signals to apply the ink droplets to the printing medium described above.

According to the present invention, there is still further provided a printing medium, comprising a liquid-absorbent paper substrate, which is composed principally of fibrous pulp and a filler and is made nonswelling, an ink-receiving layer provided on the paper substrate, which comprises a pigment, a binder and a cationic substance, and a surface layer provided on the ink-receiving layer composed principally of cationic ultrafine particles as inorganic particles.

According to the present invention, there is yet still further provided an ink-jet printing process comprising ejecting droplets of inks from ejection orifices of a printing head in response to printing signals to apply the ink droplets to the printing medium described above.

According to the present invention, there is yet still further provided an image-forming process comprising ejecting droplets of inks from ejection orifices of a printing head in response to printing signals to apply the ink droplets to the printing medium described above.

DESCRIPTION OF THE PREFERRED EMBODIMENTS

Figure 1:
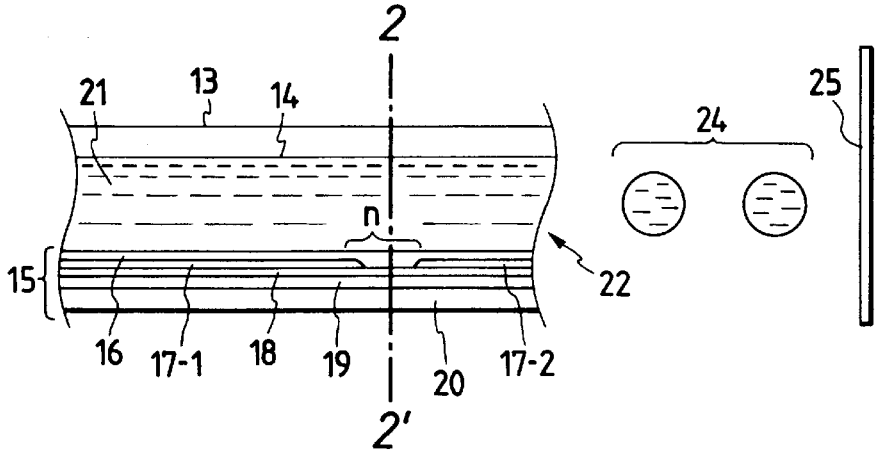
FIG. 1 is a longitudinal cross section, taken along the flow path of ink, of a head of an ink-jet printing apparatus which may be used in a process according to the present invention.

In the printing medium according to the present invention, good gloss is imparted to the surface layer thereof. In addition, the ultrafine particles making up the surface layer capture a coloring material component in an ink to fix the coloring material component to the surface layer of the coating layers provided on the base material. Therefore, printing can be performed with higher optical density. Besides, since the solvent in the ink applied to the printing medium is mainly absorbed and held in the liquid-absorbent base material, a large amount of inks can be absorbed even if the coating layers are relatively thin, and so the printing medium is particularly suitable for use in full-color printing.

As the ultrafine particles making up the surface layer, there may be used, for example, those having a particle diameter ranging from 1 nm to 500 nm. The lower limit of the particle diameter of the ultrafine particles is preferably 10 nm, while the upper limit thereof is preferably 100 nm.

If the particle diameter is smaller than 1 nm, the ink-absorbing rate of the resulting printing medium is lowered, which tends to form the cause of various print irregularities. If the particle diameter is greater than 500 nm, the desired surface gloss may not be attained in some cases.

The term "cationic ultrafine particles" as used in the present invention means particles having a positive charge on their surfaces and adsorbability of acid substances. Specific examples thereof include ultrafine particles composed of oxides of metals such as magnesium, calcium, aluminum, zinc, chromium, iron, copper, tin, lead and manganese. Those having a negative charge on their surfaces like silica may also be used if they are surface-treated to change the negative charge on the surface to a positive charge. Among the ultrafine particles of the metal oxides, particularly preferable examples include ultrafine particles of alumina having a variety of crystal structures such as $\alpha$, $\beta$, $\gamma$ and $\theta$, and alumina hydrate such as gibbsite, bayerite, nordostrandite, crystalline boehmite, diaspore and pseudoboehmite. As the most preferable ultrafine particles among these, may be mentioned ultrafine particles of pseudoboehmite.

Pseudoboehmite is also called boehmite gel and is fine particulate alumina hydrate having a needle form. The composition thereof is generally represented by $Al_2O_3.1.5—2H_2O$ and differs from that ($Al_2O_3.H_2O$) of crystalline boehmite.

Examples of the ultrafine particles of cationized silica include:

(1) silica subjected to a surface treatment with a compound containing some of the cationic metal oxides or metal atoms as described above; and (2) silica subjected to a surface treatment with an organic compound having both amino group or quaternary ammonium group thereof and functional group having reactivity to a silanol group on the surface of silica, such as aminoethoxysilane or aminoalkyl diglycidyl ether.

As described above, the surface layer is principally formed from the cationic ultrafine particles as an inorganic particle component. Therefore, the surface layer has not only a function of exhibiting surface gloss, but also a function of achieving far excellent optical density as a result that since the principal component of the surface layer is composed of particles having excellent adsorptivity to acid dyes, a dye in an ink passing through the surface layer is effectively captured by the surface layer. At the same time, a solvent component and some amount of a dye component in the ink not captured by the surface layer are absorbed into the ink-receiving layer formed under the surface layer, and so excellent ink absorbency is attained.

The surface layer in the printing medium according to the present invention is principally formed from the above-described ultrafine particles and may contain a binder resin and, optionally, other additive components.

Examples of the binder resin include water-soluble resins such as polyvinyl alcohol, starch, cationized starch, casein, gelatin, acrylic resins, sodium alginate, polyvinyl pyrrolidone, carboxymethylcellulose and hydroxyethylcellulose; latices of acrylic polymers such as polymers of acrylic esters or methacrylic esters and copolymers of these monomers with other monomers; latices of carboxyl-modified conjugated diene copolymers; and latices of vinyl copolymers such as ethylene-vinyl acetate copolymers. These binder resins may be used either singly or in any combination thereof.

A compounding ratio by weight of the ultrafine particles to the binder in the surface layer is preferably within a range of from 50/1 to 1/2 in view of surface gloss, dusting and the like.

In the present invention, fine particles of an organic resin may be used in combination, particularly, in the surface layer, thereby making the surface layer more porous. This can make the ink-fixing ability of the resulting printing medium good even when a large amount of inks is applied as in color printing.

Examples of the fine particles of the organic resin include latices of acrylic polymers such as polymers of acrylic esters or methacrylic esters and copolymers of these monomers with other monomers; latices of carboxyl-modified conjugated diene copolymers; latices of vinyl copolymers such as ethylene-vinyl acetate copolymers; fine particles of polyvinyl chloride; fine particles of polyethylene; fine particles of copolymers composed of vinylpyrrolidone and styrene; and fine particles of copolymers composed of vinyl alcohol and styrene.

Among the fine particles of the organic resins described above, the fine particles of copolymers composed of vinylpyrrolidone and styrene, and fine particles of copolymers composed of vinyl alcohol and styrene are preferred. These copolymer may be any of random, block and graft copolymers. However, random and graft copolymers are particularly preferred. Since these copolymers each have a structure exhibiting strong affinity for ink in their molecules, a probability that a coloring material in an ink is captured by the fine particles when the ink penetrates into the surface layer becomes high. Therefore, it is possible to form an image high in optical density and excellent in moisture fastness. A copolymer of vinylpyrrolidone and styrene is commercially available from GAF Corporation under the trade name of ANTARA, while a copolymer of vinyl alcohol and styrene may be obtained by saponifying a copolymer of vinyl acetate and styrene. As the fine particles of the organic resin, those having a particle diameter ranging from 0.01 $\mu$m to 5 $\mu$m, preferably from 0.05 $\mu$m to 2 $\mu$m may be used. If the particle diameter of these fine particles is smaller than 0.01 $\mu$m, an effect by adding the fine particles cannot be sufficiently obtained, which tends to form the cause of various print irregularities. If the particle diameter exceeds 5 $\mu$m, the desired surface gloss may not be attained in some cases.

A proportion of the fine particles of the organic resin to be contained in the surface layer for the above-described purpose is within a range of from 0 to 100 parts by weight, preferably from 10 to 50 parts by weight per 100 parts by weight, of the cationic ultrafine particles. If the amount of the fine particles of the organic resin is greater than 100 parts by weight, the capacity of capturing the coloring material in the surface layer is lowered, resulting in an image having an insufficient optical density.

The gloss at the surface of the surface layer of the printing medium according to the present invention is preferably 45% or higher in terms of 75° specular gloss as measured in accordance with JIS Z 8741. In order to achieve gloss comparable to a silver salt photograph, it is further preferable that the 75° specular gloss and 20° specular gloss of the surface layer be 65% or higher and 20% or higher, respectively, as measured in accordance with JIS Z 8741.

The ink-receiving layer provided on the base material in the printing medium according to the present invention is composed principally of a pigment, a binder and a cationic substance.

Examples of the pigment used in the formation of the ink-receiving layer include inorganic pigments such as silica, alumina, alumina hydrate, aluminum silicate, magnesium silicate, basic magnesium carbonate, talc, clay, hydrotalcite, calcium carbonate, titanium oxide and zinc oxide; and plastic pigments such as polyethylene, polystyrene and polyacrylate. These pigments may be used either singly or in any combination thereof. In order to form an image having higher optical density and resolution, it is preferable to use at least one selected from the group consisting of silica, alumina, alumina hydrate and basic magnesium carbonate. Of these pigment, those having a particle diameter ranging from 0.1 to 20 $\mu$m may preferably be used.

As the binder used in the formation of the ink-receiving layer, the same polymers as those usable in the above-described surface layer may be used.

The lower limit of a compounding ratio by weight of the binder to the pigment in the ink-receiving layer is 1/10, preferably 1/5, while the upper limit thereof is 2/1, preferably 1/1.

If the amount of the pigment exceeds the upper limit, the strength of the ink-receiving layer itself is lowered, and the resulting image hence tends to deteriorate its rub-off resistance and the like. On the other hand, if the binder is too great, the ink-absorbing capacity of the resulting ink-receiving layer is reduced, and so the image formed may possibly be deteriorated.

The cationic substance is contained as an essential component in the ink-receiving layer of the printing medium according to the present invention. To contain such a cationic substance in the ink-receiving layer is attained by, for example, (a) a method in which a cationic substance is contained in materials for formation of the ink-receiving layer to use it, or (b) a method in which the above-described binder is cationized to use as a cationic substance. The cationic substance contained in the ink-receiving layer acts as a fixing agent for a coloring material in an ink. When the cationic substance is present, the water fastness and moisture fastness of the resulting image can be more improved. Besides, the cationic substance has a role of finally capturing a dye, which has been unable to be captured by the surface layer, before the ink is absorbed in the liquid-absorbent base material, and is hence effective for attainment of still higher optical density.

As examples of the cationic substance usable for the method (a), may be mentioned the following substances:

(I) polyallylamine or hydrochlorides thereof, polyamine sulfone or hydrochlorides thereof, polyvinylamine or hydrochlorides thereof and chitosan or acetate thereof;

(II) homopolymers of a monomer selected from the group consisting of cationic monomers having a primary, secondary or tertiary amine on their side chains, such as dimethylaminoethyl acrylate, dimethylaminoethyl methacrylate, diethylaminoethyl acrylate, diethylaminoethyl methacrylate, methylethylaminoethyl acrylate, methylethylaminoethyl methacrylate, dimethylaminostyrene, diethylaminostyrene and methylethylaminostyrene, and monomers derived from these monomers having a quaternary ammonium salt group on their side chains, or copolymers of two or more of these monomers; and (III) copolymers of the above monomer (II) with another monomer.

Specific examples of copolymers of a quaternary ammonium salt with another monomer include copolymers of vinylpyrrolidone with a quaternary salt of an aminoalkyl acrylate and copolymers of acrylamide with a quaternary salt of aminomethylacrylamide. However, the cationic substances are not limited to the above substances.

It is convenient for the binder and cationic substance used in the formation of the ink-receiving layer to be water-soluble. However, they may be provided in the form of a dispersion such as a latex or emulsion.

The compounding amount of the cationic substance to be used in the ink-receiving layer is preferably within a range of from 0.01 to 7 g/m$^2$. If the amount is less than 0.01 g/m$^2$, the water fastness of the resulting image may become insufficient in some cases. On the other hand, any amount exceeding 7 g/m$^2$ may possibly result in an image deteriorated in light fastness. The more preferable range of the compounding amount is within a range of from 0.1 to 3 $g/m^2$.

The ink-receiving layer may further contain crosslinking agents such as melamine resins, glyoxal and isocyanates, surfactants, antifoaming agents, antioxidants, optical whitening agents, ultraviolet absorbents, viscosity modifiers, pH adjustors, mildewproofing agents, plasticizers and the like as needed. The ink-receiving layer may also be either a singly-layer structure or a multi-layer structure composed of plural layers. In the case of the multi-layer structure, such an ink-receiving layer may have either a construction that the individual layers are the same as one another or a construction that at least one of the individual layers is different from the others, namely, there is at least one combination of different constructions among the plural layers.

The ink-receiving layer of the printing medium according to the present invention has a function of absorbing an ink which has been unable to be held by the surface layer provided thereon. Since the ink-receiving layer contains the pigment, a porous structure is formed in such a layer, and so its ink absorbency is improved. The pigment particles also adsorb the coloring material in the ink. Therefore, it is more difficult for the coloring material component in the ink to penetrate into the interior, so that the coloring material component is effectively fixed to the surface of the ink-receiving layer, and an image can be formed with higher optical density. When an ink containing a coloring material having an anionic group is used, the cationic substance in the ink-receiving layer associates with the coloring material having the anionic group in the ink, whereby the water fastness and moisture resistance of the resulting image is more improved. In addition, the incorporation of the cationic substance prevents the coloring material from penetrating into the base material, so that such an ink-receiving layer has an effect of further increasing the optical density of the image.

As the base material making up the printing medium according to the present invention, any material may be used without any limitation so far as it has the desired liquid absorbency, can stably retain the desired shape of the recording medium and can attain good adhesion strength to the ink-receiving layer to be provided thereon. As such a base material, for example, a paper web may be used. Examples of the paper web for the base material include paper webs composed principally of fibrous pulp (chemical pulp typified by LBKP and NBKP, mechanical pulp, regenerated pulp from waste paper and/or the like), a size and a filler and made in accordance with a method known per se in the art with various auxiliaries for paper added as needed. In this case, one of the chemical pulp, mechanical pulp and regenerated pulp from waste paper, or a combination of two or more of these pulp materials may be used as the pulp. Examples of the size include rosin size, alkyl ketene dimers, alkenylsuccinic anhydrides, petroleum resin size, epichlorohydrin and acrylamide. Examples of the filler include calcium carbonate, kaolin, talc, titanium dioxide, and the like.

The base material of the present invention features that it is liquid-absorbent, and preferably has a Stöckigt sizing degree ranging from 0 to 15 seconds. Any Stöckigt sizing degree higher than 15 seconds results in a printing medium having insufficient ink absorbency, namely, the penetration and absorption of, particularly, a solvent component in an ink into the paper substrate (base material) becomes insufficient. The basis weight of the paper may be suitably selected within a range in which the desired stiffness is attained. For example, the upper limit thereof is preferably about 200 $g/m^2$. The lower limit thereof is about 50 $g/m^2$.

When a large amount of inks is applied to the surface layer as in color printing, including a case of forming mixed color portions, the inks (mainly, solvent components in the inks) penetrate to the paper substrate, and partial swelling of the paper substrate occurs owing to the absorption of the solvent components if a liquid-absorbent paper substrate is used like the present invention. As a result, the surface of the paper substrate partially swells, whereby delicate waves occur. This may impair the surface gloss of the coating layer. When a paper substrate which swells due to the absorption of the solvent component is used, the surface glossiness after printing tends to lower.

In order to prevent this problem, it is considered to (1) subject the surface of the paper substrate to a smoothing treatment in advance, (2) subject the paper substrate to a treatment to form nonswelling paper, or (3) mix nonswelling fiber into the paper substrate so as not to swell.

Various methods for smoothing can be used in the smoothing treatment in the method (1). An example thereof include a calendering treatment or a supercalendering treatment, in which the surface of paper is smoothed under dry conditions. As a method of treating under wet conditions, may be mentioned a casting process. Of these, the casting process is preferred. As the casting process, there may be used, for example, a process in which a finishing surface composed of a specular surface is heated in advance, and a paper substrate in a wet state is brought into contact under pressure with this heated surface to smooth the surface of the paper substrate, or a process in which a paper substrate in a wet state is dried once and then wetted again, and a heated specular surface of a finishing surface is brought into contact under pressure with this wet paper to finish the surface of the paper substrate.

It is desirable that the surface roughness of the surface of the paper substrate according to JIS B 0601 be 15 $\mu$m or smaller, preferably 10 $\mu$m or smaller as a maximum amplitude ($R_{max}$) per, for example, 2.5 mm in length.

When this method is adopted, the resulting printing medium has more improved surface glossiness at an area not printed and also retains high surface glossiness at a printed area, so that an image having high glossiness and resolution and good coloring can be obtained.

As the method (2), may be mentioned a method in which after base paper composed principally of fibrous pulp and a filler is impregnated with a crosslinking substance, this substance is crosslinked to form nonswelling paper.

Examples of the crosslinking substance to be used include those having a reactive group such as a hydroxyl, carboxyl, sulfonic, amino, carboamide, sulfoamide, blocked isocyanate, acid anhydride, epoxy or vinyl group and undergoing a crosslinking reaction in the presence of a crosslinking agent, whereby the base paper can be made nonswelling with an aqueous solvent in an ink. As such a crosslinking substance, a polymer having a reactive group as described above may be used.

Specific examples of this polymer include natural polymers such as albumin, gelatin, casein, starch, cationic starch, gum arabic, sodium alginate, hydroxyethylcellulose and carboxymethylcellulose, and modified products thereof, polyvinyl alcohol, polyamide, polyacrylamide, quaternized polyvinyl pyrrolidone, polyvinylpyridinium halides, melamine resins, sodium polyacrylate, completely or partially saponified products of copolymers of vinyl acetate with other monomers, homopolymers of unsaturated carboxylic acids such as (meth)acrylic acid, maleic acid and crotonic acid, homopolymers of sulfonated vinyl monomers such as vinylsulfonic acid and sulfonated styrene, and copolymers with other monomers, homopolymers of (meth) acrylamide and copolymers with other monomers, homopolymers of ethylene oxide and copolymers with other monomers, terminal polyurethane having a blocked isocyanate group, and polyamides, polyethyleneimines, polyurethanes and polyesters having a reactive group as described above. These polymers may be used either singly or in combination of two or more thereof as needed. Among these, hydrophilic or water-soluble polymers are particularly preferably used.

The crosslinking agent for these polymers may be selected from the known agents according to the kind of a water-soluble polymer to be used. For example, polyaldehyde compounds, polyepoxy compounds, polyisocyanate compounds, polycarboxylic acids, acid anhydrides and the like are preferably used when the reactive group of the water-soluble polymer is a hydroxyl group, while polyamine compounds, polyisocyanate compounds, polyepoxy compounds, polyol compounds, polyvalent metal ions and the like are preferably used when the reactive group of the water-soluble polymer is a carboxyl group.

As epoxy resins usable as the polyepoxy compounds, there may be used epoxy resins having a plurality of epoxy groups obtained by, for example, reacting epichlorohydrin or epibromohydrin with a polyhydric alcohol, such as bisphenols such as bisphenol A, ethylene glycol, diethylene glycol, polyethylene glycol, propylene glycol, dipropylene glycol, polypropylene glycol, glycerol, diglycerol, pentaerythritol, trimethylene glycol, tetramethylene glycol, pentamethylene glycol, polyester polyol or polyether polyol. These epoxy resins may range from low-molecular weight resins to high-molecular weight resins according to the reacting proportion of epichlorohydrin or epibromohydrin, and also from water-soluble resins to water-insoluble resins according to the selection of the polyhydric alcohol. Therefore, they may be suitably selected as desired.

It is preferable to select the crosslinking substance and the crosslinking agent from combinations in which at least one of them is water-soluble. It is also preferable to select a high-molecular weight crosslinking agent when the crosslinking substance is low-molecular-weight, or a low-molecular weight crosslinking agent when the crosslinking substance is high-molecular-weight.

The compounding ratio of the crosslinking substance to the crosslinking agent is preferably within a range of from 100/1 to 1/1 by weight. The crosslinking substance and the crosslinking agent are preferably bonded by covalent bonding. However, they may be bonded by hydrogen bonding or ionic bonding so far as the swelling tendency of the base paper can be inhibited. It is most preferable that such a bond be formed by applying, heating and drying a coating formulation containing the above materials. However, it may be formed by using ultraviolet radiation or electron radiation.

As a method for applying the crosslinking substance and the crosslinking agent to the base paper, various processes such as roll coater, blade coater, air knife coater, gate roll coater, bar coater, size pressing, spray coater, gravure coater and curtain coater processes may be used.

The amount of these substances to be impregnated into the base paper is preferably within a range of from 0.5 to 10 $g/m^2$. The upper and lower limits thereof are more preferably 5 $g/m^2$ and 1 $g/m^2$, respectively.

As described above, the base paper is made nonswelling by the crosslinking of the crosslinking substance with the crosslinking agent to use the thus-treated paper as a paper substrate in the production of the printing medium according to the present invention.

As the paper substrate according to the method (3), any paper substrate may be used without any particular limitation so far as it is obtained by mixing fibrous pulp with nonswelling fiber, can stably retain the desired shape of the recording medium and can attain good adhesion strength to the ink-receiving layer to be provided thereon. As such a base material, may be mentioned a paper web made from a paper stock composed principally of the above pulp, nonswelling fiber and a filler and optionally containing a size and various auxiliaries for paper in accordance with a method known per se in the art.

As the nonswelling fiber, fiber made of a material which undergoes no swelling due to the absorption of an water-based ink, in particular, an aqueous solvent component or scarcely undergoes such swelling may be used. For example, glass fiber or fiber made of a hydrophobic resin such as polyester, nylon or acrylic resin may be used.

A mixing ratio of the fibrous pulp to the nonswelling fiber is such that good absorption of a solvent component in an ink into the paper substrate is achieved, and swelling of the paper substrate can be prevented. For example, the ratio is preferably within a range of from 9/1 to 5/5 by weight.

If the proportion of the fibrous pulp is higher than 9/1, the desired effect of such mixing cannot be fully exhibited. On the other hand, if the proportion of the nonswelling fiber is higher than 5/5, the resulting printing medium exhibits insufficient ink-absorbing capacity and hence becomes unfit for formation of a full-color image.

The printing medium according to the present invention having the above-described construction can be obtained in accordance with, for example, the following process. The above materials for formation of the ink-receiving layer are first added together with optional other additives to a proper solvent, for example, water, alcohol or various organic solvents, to prepare a coating formulation. This coating formulation is applied to the base material and dried to form an ink-receiving layer. The ink-receiving layer may be of a multi-layer structure as needed. In the formation of the coating layer, various coating processes, for example, roll coater, blade coater, air knife coater, gate roll coater, bar coater, size pressing, spray coater, gravure coater and curtain coater processes may be used. When a coating layer composed of plural layers is provided as the ink-receiving layer, a coating formulation for formation of a first layer is first applied and then dried by the conventional method to form the first layer. A coating formulation for formation of a second layer is applied onto the first layer and dried to form the second layer. Further, the desired number of coating layers is successively applied one on another, as needed, whereby the ink-receiving layer of the multi-layer structure can be obtained. The upper limit of the total coating weight of the ink-receiving layer is about 40 $g/m^2$, preferably about 10 $g/m^2$. The lower limit thereof is about 3 $g/m^2$.

After the ink-receiving layer is formed on the base material in this manner, a coating formulation for formation of the surface layer is applied onto the ink-receiving layer, whereby a glossy surface layer can be obtained. The coating formulation can be prepared by adding materials for formation of the surface layer together with optional other additives to a proper solvent, for example, water, alcohol or various organic solvents. In the formation of the surface layer, the same various coating process as those used in the formation of the ink-receiving layer may be used. The upper limit of the coating weight of the surface layer is about 40 $g/m^2$, preferably about 10 $g/m^2$. The lower limit thereof is about 1 $g/m^2$, preferably about 3 $g/m^2$. If the coating weight is less than the lower limit, the surface gloss of the resulting surface layer becomes insufficient. If the coating weight exceeds the upper limit, the ink-absorbing rate of the resulting printing medium is lowered, so that the printing medium tends to cause image irregularity.

Although the printing medium according to the present invention obtained in the above manner has sufficient surface gloss, it may be subjected to a surface treatment by a casting process so as to more enhance the surface gloss. As the casting process, there may be used, for example, a wet casting process in which a finishing surface composed of a specular surface is heated in advance, and a wet coating layer is brought into contact under pressure with this heated surface to conduct gloss finish, a rewet casting process in which a wet coating layer is dried once, the dry coating layer is wetted again to plasticize it, and a heated specular surface of a finishing surface is then brought into contact under pressure with the rewetted coating layer to conduct gloss finish, or a gel casting process in which a wet coating layer is gelatinized, and a heated specular surface of a finishing surface is brought into contact under pressure with the gelled coating layer.

The formation of an image by an ink-jet printing method on the printing medium according to the present invention having the above-described construction can be performed in the following manner.

As inks to be used in the formation of an image, any inks may be used with no limitation so far as they are inks applicable to an ink-jet system. Examples thereof include those compositions comprising, as essential components, a coloring material for forming an image and a liquid medium dissolving or dispersing this coloring material therein and optionally containing various dispersants, surfactants, viscosity modifiers, resistivity regulative agents, pH adjustors, mildewproofing agents, stabilizers to dissolution or dispersion of the coloring material, and the like.

Example of coloring materials used in the inks include direct dyes, acid dyes, basic dyes, reactive dyes, food colors, disperse dyes, oil colors and various pigments, and those conventionally known may be used without any limitation. The content of the coloring material in an ink is determined on the basis of properties required of the ink, and the like. However, the coloring material may be used in a general concentration of from about 0.1 to 20% by weight. As described above, when an ink containing a coloring material having an anionic group is used, the cationic substance in the ink-receiving layer associates with the coloring material having the anionic group in the ink, whereby the water fastness and moisture fastness of the resulting image is more improved.

As the liquid medium used in the dissolution or dispersion of the coloring material, water or a mixed solvent of water and a water-soluble organic solvent may be used. Examples of the water-soluble organic solvents include alkyl alcohols such as methanol, ethanol, isopropyl alcohol and n-butanol; amides such as dimethylformamide and dimethylacetamide; ketones and keto-alcohols such as acetone and diacetone alcohol; alkylene glycols such as ethylene glycol, propylene glycol, triethylene glycol, thiodiglycol, diethylene glycol and polyethylene glycol; 1,2,6-hexanetriol; glycerols; alkyl ethers of polyhydric alcohols, such as (di)ethylene glycol monomethyl (or monoethyl) ether and triethylene glycol mono- or dimethyl (or mono- or diethyl) ether; sulfolane; N-methyl-2-pyrrolidone; 1,3-dimethyl-2-imidazolidinone; and the like. These solvents may be used either singly or in any combination thereof. Among these, water-miscible glycols or glycol ethers having an effect of preventing the drying of ink in a printing head are often used.

As a printing head suitable for use in the image-forming process according to the present invention, a printing head of any system may be used so far as it can effectively eject an ink out of an ejection orifice provided on the tip of an ink flow path to apply droplets of the ink to the printing medium as a target. Among others, a system described in Japanese Patent Application Laid-Open No. 54-59936, in which an ink undergoes a rapid volumetric change by an action of thermal energy applied to the ink in a flow path of the ink, so that the ink is ejected out of an ejection orifice provided on the tip of the ink flow path by the working force generated by this change of state, may preferably be used.

Figure 2:
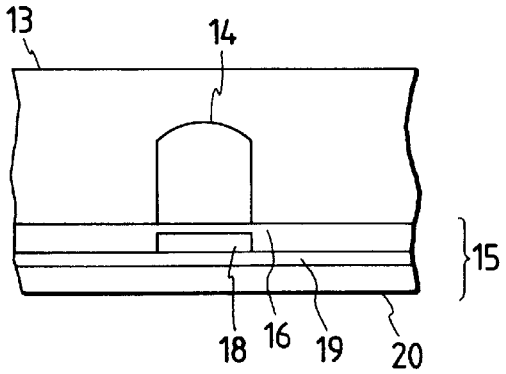
FIG. 2 is a transverse cross section, taken along line 2–2', of the head shown in FIG. 1.
Figure 3:
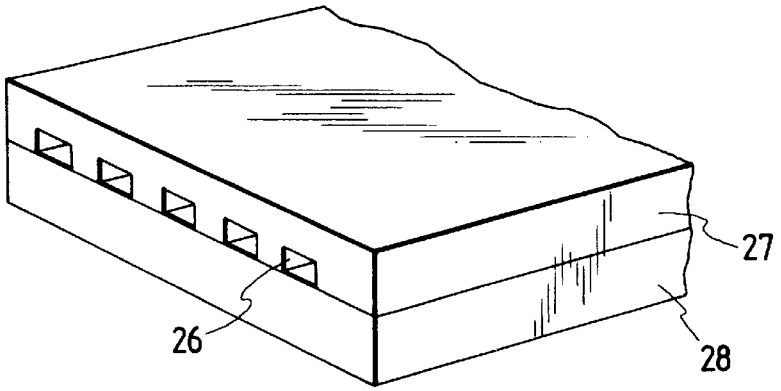
FIG. 3 is a perspective view of the appearance of a multi-head in which a plurality of ink flow paths is arranged side by side.

An illustrative example of an ink-jet printing apparatus, which may be employed in the ink-jet printing process used in the image-forming process according to the present invention, will hereinafter be described with reference to the drawings. Examples of the construction of a head, which is a main component of such an apparatus, are illustrated in FIGS. 1, 2 and 3. FIG. 1 is a cross-sectional view of a printing head taken along the flow path of ink, and FIG. 2 is a cross-sectional view taken along line 2–2' in FIG. 1. A printing head 13 is formed by bonding a glass, ceramic or plastic plate or the like having a groove 14 through which an ink is passed, to a heating head 15 (the construction of the heating head is not limited to the illustrated one). The heating head 15 is composed of a heat accumulating layer 19, a heating resistor layer 18 formed of nichrome or the like, electrodes 17-1 and 17-2 made of aluminum or the like and a protective layer, which have been laminated in that order on a substrate 20 made of alumina or the like having a good heat radiating property, and serves to generate heat at portions of the heating resistor layer 18 (portions in a region shown by n), on which the electrodes are not laminated, by energizing the electrodes 17-1 and 17-2, thereby applying thermal energy to an ink situated thereon.

Upon printing, an ink 21 is filled up to an ejection orifice 22, which is a minute opening situated at an end of the groove 14. When the electrodes 17-1 and 17-2 are energized in response to a printing signal in this state, he heating head 15 rapidly generates heat at the region shown by n to form bubbles in the ink 21 which is in contact with this region, and the ink 21 is ejected by the pressure thus produced from the orifice 22 toward a printing medium 25 in the form of minute droplets 24.

FIG. 3 illustrates an appearance of a multi-head composed of an array of a number of heads as shown in FIG. 1. This multi-head is obtained by bonding a grooved plate 27 having a number of grooves 26, which define ink flow paths arranged side by side, to a heating head 28 formed in such a manner that the same heating regions (n) as illustrated in FIG. 1 are arranged at the predetermined positions in the respective grooves.

Figure 4:
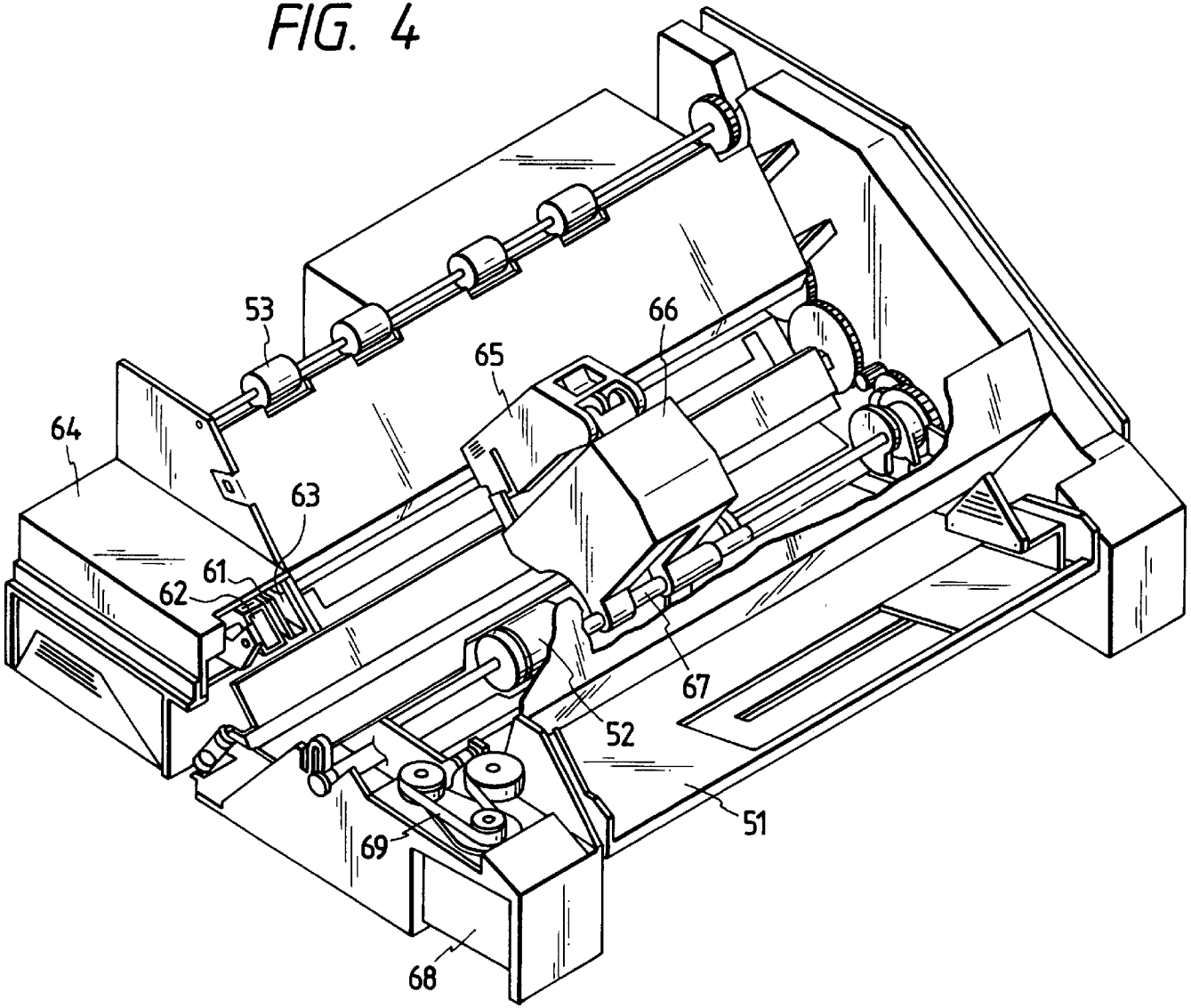
FIG. 4 is a perspective view schematically illustrating an ink-jet printing apparatus which may be used in a process according to the present invention.

FIG. 4 illustrates an example of an ink-jet printing apparatus in which such a multi-head as illustrated in FIG. 3 has been incorporated. In FIG. 4, reference numeral 61 designates a blade serving as a wiping member, one end of which is a stationary end held by a blade-holding member to form a cantilever. The blade 61 is provided at the position adjacent to the region in which a printing head operates, and in this embodiment, is held in such a form that it protrudes into the course through which the printing head is moved. Reference numeral 62 indicates a cap, which is provided at the home position adjacent to the blade 61, and is so constituted that it moves in a direction perpendicular to a direction in which the printing head is moved and comes into contact with the face of ejection orifices to cap it. Reference numeral 63 denotes an ink-absorbing member provided adjoiningly to the blade 61 and, similar to the blade 61, held in such a form that it protrudes into the course through which the printing head is moved. The above-described blade 61, cap 62 and absorbing member 63 constitute an ejection-recovery portion 64, where the blade 61 and absorbing member 63 remove water, dust and/or the like from the face of the ink-ejecting openings.

Reference numeral 65 designates the printing head which conducts printing in accordance with an ink-jet recording system and has a construction that an ink is ejected by, for example, thermal energy as illustrated in FIGS. 1 to 3. Reference numeral 66 indicates a carriage on which the printing head 65 is mounted so that the printing head 65 can be moved. The carriage 66 is slidably interlocked with a guide rod 67 and is connected (not illustrated) at its part to a belt 69 driven by a motor 68. Thus, the carriage 66 can be moved along the guide rod 67 and hence, the printing head 65 can be moved from a printing region to a region adjacent thereto.

Reference numerals 51 and 52 denote a paper feeding part from which the printing media are separately inserted, and paper feed rollers driven by a motor (not illustrated), respectively. With such a construction, the printing medium is fed to the position opposite to the ejection opening face of the printing head, and discharged from a paper discharge section provided with paper discharge rollers 53 with the progress of printing.

In the above construction, the cap 62 in the head recovery portion 64 is receded from the path of motion of the printing head 65 when the printing head 65 is returned to its home position, for example, after completion of printing, and the blade 61 remains protruded into the path of motion. As a result, the ejection opening face of the printing head 65 is wiped. When the cap 62 comes into contact with the ejection opening face of the printing head 65 to cap it, the cap 62 is moved so as to protrude into the path of motion of the printing head 65.

When the printing head 65 is moved from its home position to the position at which printing is started, the cap 62 and the blade 61 are at the same positions as the positions for the wiping as described above. As a result, the ejection opening face of the printing head 65 is also wiped at the time of this movement.

The above movement of the printing head 65 to its home position is made not only when the printing is completed or the printing head is recovered for ejection, but also when the printing head 65 is moved between printing regions for the purpose of printing, during which it is moved to the home position adjacent to each printing region at given intervals, where the ejection opening face is wiped in accordance with this movement.

In the case of color printing, printing may be performed by using either a printing head in which ejection orifices for cyan, magenta, yellow and black inks are arranged side by side, or printing heads for cyan, magenta, yellow and black inks arranged side by side. In this case, ejection of each of the color inks may be effected through one ejection orifice or through a plurality of ejection orifices so as to apply two or more ink droplets of the same color to the printing medium at the same time.

The present invention will hereinafter be described more specifically by the following examples. Incidentally, all designations of "part" or "parts" as will be used in the following examples mean part or parts by weight unless expressly noted.

Referential Example 1

A base paper web for a printing medium having a basis weight of 80 g/m$^2$ was made by mixing, as raw pulp, 90 parts of LBKP and 10 parts of NBKP, beating the mixture, and then incorporating 10 parts of kaolin (product of Tsuchiya Kaolin Ind., Ltd.), 0.05 part of a neutral rosin size (Sizepine NT, trade name, product of Arakawa Chemical Industries, Ltd.) and 0.1 part of aluminum sulfate into the mixture in accordance with a method known per se in the art. The thus-obtained base paper web had a sizing degree of 5 seconds.

EXAMPLES 1 TO 3

Sheet-like printing media according to the present invention were obtained by separately using coating formulations (1) and (2) of their corresponding combinations and compositions shown in Tables 1 to 3. More specifically, in each combination, the coating formulation (1) was first applied onto the base paper web obtained in Referential Example 1 using a wire bar so as to give a dry coating weight of 10 g/m$^2$, and then dried at 100° C. for 5 minutes, thereby forming an ink-receiving layer. Thereafter, the coating formulation (2) was applied onto the ink-receiving layer using a wire bar so as to give a dry coating weight of 8 g/m$^2$, and then dried at 100° C. for 5 minutes to form a surface layer, thereby obtaining sheet-like Printing Media 1 to 3 according to the present invention.

TABLE 1

Compositions of coating formulations for Example 1 Printing Medium 1

| | Composition (parts) |
|---|---|
| Component of coating formulation (1) | |
| Alumina (AKP-G015, trade name, product of Sumitomo Chemical Co., Ltd.) | 100 |
| Polyvinyl alcohol (PVA-117, trade name, product of Kuraray Co., Ltd.) | 15 |
| Polyallylamine hydrochloride (PAAHcl-3L, trade name, product of Nitto Boseki Co., Ltd.) | 10 |
| Water | 875 |
| Component of coating formulation (2) | |
| Cationized silica A*) | 100 (solids) |
| Cationized polyvinyl alcohol (PVA-CM-318, trade name, product of Kuraray Co., Ltd.) | 20 |
| Water | 880 |

*)Synthesis of cationized silica A: One liter of a 20% slurry of colloidal silica (Snowtex 20, trade name, product of Nissan Chemical Industries, Ltd.) having a particle diameter of 10 to 20 nm was heated to 80° C., with which 10 g of γ-aminopropyl-triethoxysilane (KBE-903, trade name, product of Shin-Etsu Silicon Co., Ltd.) were mixed with stirring. The mixture was stirred further for 2 hours, thereby obtaining silica the surface of which was subjected to a cationized treatment.

TABLE 2

| Compositions of coating formulations for Example 2 Printing Medium 2 | Composition (parts) |
|---|---|
| Component of coating formulation (1) | |
| Alumina (AKP-G030, trade name, product of Sumitomo Chemical Co., Ltd.) | 50 |
| Basic magnesium carbonate (product of Tokuyama Soda Co., Ltd.) | 50 |
| Polyvinyl alcohol (PVA-117, trade name, product of Kuraray Co., Ltd.) | 15 |
| Copolymer of monoallylamine/dimethylamine hydrochloride (PAA-D11-Hcl, trade name, product of Nitto Boseki Co., Ltd.) | 10 |
| Water | 975 |
| Component of coating formulation (2) | |
| Cationized silica B*) | 100 (solids) |
| Cationized polyvinyl alcohol (PVA-CM-318, trade name, product of Kuraray Co., Ltd.) | 20 |
| Water | 880 |

*)Synthesis of cationized silica B: Two hundred grams of vapor-phase process silica (Aerosil 200, trade name, product of Degussa) having a particle diameter of 12 nm were dispersed in 1 liter of water to prepare a slurry. Thereafter, the slurry was treated in the same manner as in the synthesis of the cationized silica A to obtain silica the surface of which was subjected to a cationized treatment.

TABLE 3

| Compositions of coating formulations for Example 3 Printing Medium 3 | Composition (parts) |
|---|---|
| Component of coating formulation (1) | |
| Silica (Mizukasil P-78D, trade name, product of Mizusawa Industrial Chemicals, Ltd.) | 100 |
| Polyvinyl alcohol (PVA-117, trade name, product of Kuraray Co., Ltd.) | 15 |
| Polyallylamine (PAA-10C, trade name, product of Nitto Boseki Co., Ltd.) | 10 |
| Water | 975 |
| Component of coating formulation (2) | |
| Cationic colloidal silica (Snowtex AK, trade name, product of Nissan Chemical Industries, Ltd.) | 100 (solids) |
| Cationized polyvinyl alcohol (PVA-CM-318, trade name, product of Kuraray Co., Ltd.) | 20 |
| Water | 880 |

EXAMPLES 4 TO 6

Sheet-like printing media according to the present invention were obtained by separately using coating formulations (1) and (2) of their corresponding combinations and compositions shown in Tables 4 to 6. More specifically, in each combination, the coating formulation (1) was first applied onto the base paper web obtained in Referential Example 1 using a wire bar so as to give a dry coating weight of 10 g/m$^2$, and then dried at 100° C. for 5 minutes, thereby forming an ink-receiving layer. Thereafter, the coating formulation (2) was applied onto the ink-receiving layer using a wire bar so as to give a dry coating weight of 5 g/m$^2$, and then dried at 100° C. for 5 minutes, thereby obtaining sheet-like Printing Media 4 to 6 according to the present invention.

TABLE 4

| Compositions of coating formulations for Example 4 Printing Medium 4 | Composition (parts) |
|---|---|
| Component of coating formulation (1) | |
| The same as the coating formulation (1) in Example 1 | |
| Component of coating formulation (2) | |
| γ-Alumina sol (Alumina Sol 520, trade name, product of Nissan Chemical Industries, Ltd.) | 100 (solids) |
| Polyvinyl alcohol (PVA-117, trade name, product of Kuraray Co., Ltd.) | 10 |
| Water | 890 |

TABLE 5

| Compositions of coating formulations for Example 5 Printing Medium 5 | Composition (parts) |
|---|---|
| Component of coating formulation (1) | |
| The same as the coating formulation (1) in Example 2 | |
| Component of coating formulation (2) | |
| Pseudoboehmite sol (AS-3, trade name, particle diameter: 10 to 100 nm, product of Catalysts & Chemicals Industries Co., Ltd.) | 100 (solids) |
| Polyvinyl alcohol (PVA-117, trade name, product of Kuraray Co., Ltd.) | 10 |
| Water | 890 |

TABLE 6

| Compositions of coating formulations for Example 6 Printing Medium 6 | Composition (parts) |
|---|---|
| Component of coating formulation (1) | |
| The same as the coating formulation (1) in Example 3 | |
| Component of coating formulation (2) | |
| Pseudoboehmite C*) | 100 (solids) |
| Polyvinyl alcohol (PVA-117, trade name, product of Kuraray Co., Ltd.) | 10 |
| Water | 890 |

*)Preparation of pseudoboehmite C: A 2-liter five-necked separable flask equipped with a condenser was charged with 1607 g of deionized water having a specific conductivity of 6 nΩ/cm. Then, 24 g of 99.3% acetic acid (glacial acetic acid) were added, and the temperature inside the flask was raised to 80° C. with stirring, followed by careful addition of 25.7 g of aluminum powder (containing −250 mesh particles in a proportion of 95% or higher) having a purity of 99.3% (a mixing ratio of Al to acetic acid = 1/0.42 by mole) to conduct a reaction at 80° C. for 10 hours. The reaction temperature was then raised to 93 to 95° C. to continue the reaction further for 20 hours. Thereafter, the heating and stirring were stopped, thereby obtaining transparent alumina sol containing 3% of alumina. This sol was dried at room temperature to obtain needle-like pseudoboehmite having a particle diameter of 10 to 100 nm.

Comparative Example 1

After going through the same procedure as in Example 1 until the formation of an ink-receiving layer, a coating formulation (2) having a composition shown in Table 7 was applied onto the ink-receiving layer so as to give a dry coating weight of 5 g/m$^2$, and then dried by bringing the thus-formed coating film into contact under pressure with a stainless steel roll heated to 100° C. while the coating film was in a wet state, thereby obtaining sheet-like Printing Medium A.

TABLE 7

Composition of a coating formulation (2) for Comparative Example 1

| Component | Composition (parts) |
|---|---|
| Low-density polyethylene resin (Chemipearl M-200, trade name, product of Mitsui Petrochemical Industries, Ltd.) | 50 |
| Ionomer resin (Chemipearl SA-100, trade name, product of Mitsui Petrochemical Industries, Ltd.) | 7 |
| Colloidal silica (Snowtex YL, trade name, product of Nissan Chemical Industries, Ltd.) | 50 (solids) |
| Calcium stearate | 3 |
| Water | 490 |

Comparative Example 2

Sheet-like Printing Medium B was obtained in the same manner as in Example 1 except that only the ink-receiving layer was formed without providing the surface layer.

EXAMPLE 7

Using inks each having a composition shown in Table 8, color printing was conducted on the coated sides of the sheet-like Printing Media 1 to 6, and A and B obtained in Examples 1 to 6, and Comparative Examples 1 and 2 under the following conditions by means of an ink-jet printing apparatus in which an ink is ejected by bubbling of the ink by thermal energy. Combinations of the printing medium with the inks used in printing are shown in Table 9.

TABLE 8

Composition of ink

| Component | Composition (parts) |
|---|---|
| Dye*) | 4 |
| Glycerol | 6 |
| Thiodiglycol | 6 |
| Urea | 8 |
| Acetylene glycol (Surfynol 104, trade name, product of Nissin Chemical Industry Co., Ltd.) | 1 |
| Water | 75 |

*) Dye:
Y: C.I. Direct Yellow #86
M: C.I. Acid Red #23
C: C.I. Direct Blue #199
Bk: C.I. Food Black #2.
Printing conditions:
Ejection frequency: 5 kHz
Volume of ejection droplet: 50 pl
Printing density: 360 DPI
Maximum printing density of a single color ink: 10 nl/mm$^2$.

The resulting color print samples were evaluated as to the following items.

[Evaluated Items]

(1) Optical density:

Optical densities of solid printed areas of black (Bk), cyan (C), Magenta (M) and yellow (Y) colors were separately measured by means of a Macbeth Densitometer RD-918.

(2) Surface glossiness:

With respect to each printing medium sample, the 75° and 20° specular glossinesses of the blank area of its coated surface were measured by means of a digital gonioglossmeter, UGV-5D (trade name, manufactured by SUGA TEST INSTRUMENTS CO., LTD.) in accordance with JIS Z 8741.

The thus-obtained results are shown in Table 9.

TABLE 9

Results of evaluation

| | Example | | | | | | Comp. Ex. | |
|---|---|---|---|---|---|---|---|---|
| Evaluation item | 1 | 2 | 3 | 4 | 5 | 6 | 1 | 2 |
| Printing medium | 1 | 2 | 3 | 4 | 5 | 6 | A | B |
| Optical density | | | | | | | | |
| Bk | 1.61 | 1.60 | 1.58 | 1.56 | 1.55 | 1.52 | 1.33 | 1.56 |
| C | 1.50 | 1.50 | 1.47 | 1.44 | 1.43 | 1.43 | 1.29 | 1.47 |
| M | 1.72 | 1.71 | 1.70 | 1.68 | 1.67 | 1.66 | 1.55 | 1.70 |
| Y | 1.35 | 1.36 | 1.35 | 1.31 | 1.28 | 1.28 | 1.20 | 1.32 |
| Surface glossiness (%) | | | | | | | | |
| 75° | 81 | 81 | 80 | 78 | 78 | 78 | 75 | 2 |
| 20° | 32 | 32 | 30 | 30 | 29 | 30 | 28 | 1 |

As described in the above Examples, the surface layers in the printing media according to the present invention are formed principally of ultrafine particles. Therefore, the printing media are excellent in printability such as ink absorbency and the ability to fix coloring materials in inks in printing using water-based inks, in particular, ink-jet printing, have a high surface glossiness and permit the formation of images having good water fastness and moisture fastness. As a result, according to the ink-jet printing process using the printing media of the present invention, images having excellent optical density and surface gloss in particular can be provided, so that prints of quality comparable to a silver salt photograph can be provided.

EXAMPLE 8

(Preparation of Printing Media 7 to 9)

A base paper web (base material) having a basis weight of 72 g/m$^2$ and a Stöckigt sizing degree of 10 seconds was made by mixing, as raw pulp, 90 parts of LBKP and 10 parts of NBKP, beating the mixture, and then incorporating 10 parts of kaolin (product of Tsuchiya Kaolin Ind., Ltd.), 0.08 part of alkenylsuccinic anhydride and 0.2 part of cationized starch into the mixture in accordance with a method known per se in the art. A coating formulation (1) for formation of an undercoat was then applied onto the above-obtained base material using a wire bar so as to give a dry coating weight of 10 g/m$^2$, and then dried at 100° C. for 5 minutes, thereby forming an undercoat.

A coating formulation (2) for formation of a surface layer was then applied onto the undercoat using a wire bar so as to give a dry coating weight of 5 g/m$^2$, and then dried by bringing the thus-formed coating layer into contact under pressure with a mirror-finished stainless steel roll heated to 120° C. while the coating layer was in a wet state, to form a surface layer, thereby obtaining sheet-like Printing Media 7 to 9 according to the present invention. The compositions of the coating formulations (1) and the coating formulations (2) used in the formation of the coating layers in the respective printing media are shown in Table 10.

TABLE 10

Compositions of coating formulations for Example 8

| | Composition (parts) |
|---|---|
| **Printing Medium 7** | |
| Component of coating formulation (1) | |
| The same as the coating formulation (1) in Example 1 | |
| Component of coating formulation (2) | |
| Styrene-butadiene latex (product of Sumitomo Naugatuck Co., Ltd.) | 50 |
| Ionomer resin (Chemipearl SA-100, trade name, product of Mitsui Petrochemical Industries, Ltd.) | 7 |
| Pseudoboehmite (AS-3, trade name, product of Catalysts & Chemicals Industries Co., Ltd.) | 50 (solids) |
| Calcium stearate | 3 |
| Water | 490 |
| **Printing Medium 8** | |
| Component of coating formulation (1) | |
| The same as the coating formulation (1) in Example 2 | |
| Component of coating formulation (2) | |
| Ethylene-vinyl acetate copolymer resin (Flowback Q16079N, trade name, product of Seitetsu Kagaku Co., Ltd.) | 75 |
| Pseudoboehmite (AS-3, trade name, product of Catalysts & Chemicals Industries, CO., Ltd.) | 50 (solids) |
| Calcium stearate | 5 |
| Water | 470 |
| **Printing Medium 9** | |
| Component of coating formulation (1) | |
| The same as the coating formulation (1) in Example 3 | |
| Component of coating formulation (2) | |
| Styrene-butadiene rubber (JSR6619, trade name, product of Japan Synthetic Rubber Co., Ltd.) | 65 |
| Pseudoboehmite (the same as that used in Example 6) | 50 (solids) |
| Zinc stearate | 3 |
| Water | 482 |

EXAMPLE 9

(Preparation of Printing Medium 10)

The same coating formulation (1) for formation of an undercoat as that used in Printing Medium 7 shown in Table 10 was applied onto a base paper web (base material) made in the same manner as in Example 8 using a wire bar so as to give a dry coating weight of 10 g/m$^2$, and then dried at 100° C. for 5 minutes, thereby forming an undercoat. A coating formulation (2) for formation of a surface layer having a composition shown in Table 11 was then applied onto the undercoat using a wire bar so as to give a dry coating weight of 10 g/m$^2$. The thus-formed coating layer was dried at 60° C. for 20 minutes, and then supercalendered at 80° C., thereby obtaining sheet-like Printing Medium 10 according to the present invention.

TABLE 11

Composition of a coating formulation (2) for formation of the surface layer of Printing Medium 10

| Component | Composition (parts) |
|---|---|
| Low-density polyethylene resin (Chemipearl M-200, trade name, product of Mitsui Petrochemical Industries, Ltd.) | 50 |
| Ionomer resin (Chemipearl SA-100, trade name, product of Mitsui Petrochemical Industries, Ltd.) | 7 |
| Pseudoboehmite (AS-3, trade name, product of Catalysts & Chemicals Industries Co., Ltd.) | 50 (solids) |
| Calcium stearate | 3 |
| Water | 490 |

Comparative Example 3

(Preparation of Comparative Printing Media C to E)

The following printing media were provided for the sake of comparison.

(i) Printing Medium C:

Printing Medium C was prepared in the same manner as in Printing Medium 7 of Example 8 except that only the undercoat was provided.

(ii) Printing Medium D:

Printing Medium D was prepared in the same manner as in Printing Medium 7 of Example 8 except that the pseudoboehmite used in the coating formulation (2) was changed to colloidal silica (Snowtex, trade name, product of Nissan Chemical Industries, Ltd.).

(iii) Printing Medium E:

Printing Medium E was prepared in the same manner as in Printing Medium 7 of Example 8 except that the pseudoboehmite was omitted from the coating formulation (2).

EXAMPLE 10

Color printing was conducted on the Printing Media 7 to 10 obtained in Examples 8 and 9 in the same manner as in Example 7.

The resulting color print samples were evaluated as to the following items. The results thereof are shown in Table 12.

[Evaluated Items]

(1) Optical density:

Solid printing was conducted on each printing medium with the black ink by means of the above-described printing apparatus, and the optical density of the resultant solid print was measured by means of a Macbeth Densitometer RD-918 (manufactured by Macbeth Co.).

(2) Surface glossiness:

With respect to each printing medium sample, the 75° and 20° specular glossinesses of the blank area of its coated surface were measured by means of a digital gonioglossmeter, UGV-5D (trade name, manufactured by SUGA TEST INSTRUMENTS CO., LTD.) in accordance with JIS Z 8741.

(3) Water fastness:

A drop of water was placed by a dropping pipette on printed characters and air-dried, thereby visually evaluating the water fastness of the image to rank it as A where no deformation of the image occurred, AA where neither deformation of the image nor dot gain occurred, or C where deformation of the image occurred. B where deformation of the image occurred, but the image is readable.

(4) Moisture fastness:

Reverse characters were printed by means of the above-described printing apparatus within a solid printed area of a blue color, and the thus-obtained print was left over for 1 week in an atmosphere of 30° C. and 80% RH, thereby evaluating the moisture fastness by visually observing whether the image was changed or not, to rank it as C where the reverse characters were deformed, or A where no practical problem was caused.

(5) Evenness of solid print:

Solid prints of red, green and blue colors were made by overlap printing of different colors, and the evenness of solid print was evaluated and ranked as A where no unevenness of color strength was recognized on each solid print, C where unevenness of color strength was visually recognized even when observing the print 25 cm apart from the eyes, or B where it was in-between thereof.

(6) Overall evaluation:

In view of all the results as to the above evaluation items (1) to (5), the overall evaluation was ranked as B where the objects of the present invention were achieved, A where the objects were excellently achieved, or C where the objects were not achieved.

Comparative Example 4

The printing media prepared in Comparative Example 3 were used to conduct color printing in the same manner as in Example 10. The resulting color print samples were evaluated in the same manner as in Example 10. The results thereof are shown in Table 12.

TABLE 12

| | Invention Medium | | | | Comp. medium | | |
|---|---|---|---|---|---|---|---|
| | 7 | 8 | 9 | 10 | C | D | E |
| Optical density | 1.54 | 1.52 | 1.55 | 1.52 | 1.49 | 1.38 | 1.30 |
| Glossiness | | | | | | | |
| 75° (%) | 75 | 75 | 78 | 53 | 2 | 75 | 79 |
| 20° (%) | 27 | 26 | 29 | 15 | 1 | 28 | 30 |
| Water fastness | AA | AA | AA | AA | AA | AA | B |
| Moisture fastness | A | A | A | A | A | C | C |
| Evenness of solid print | A | A | A | A | A | A | C |
| Overall evaluation | A | A | A | B | C | C | C |

According to the present invention, as described above, printing media which satisfies the properties, which are required upon formation of images by applying ink droplets to a printing surface as in ink-jet printing, in a well-balanced relation can be provided. According to the present invention, in particular, printing media suitable for use in forming images having high optical density, resolution and gloss and moreover good water fastness and moisture fastness can be provided. As a result, according to the ink-jet printing process using the printing media of the present invention, images having high optical density and resolution and good gloss and moreover superb water fastness and moisture fastness can be formed. Further, the present invention can also provide prints of quality comparable to a silver salt photograph.

EXAMPLES 11 TO 20

Preparation of Paper Substrate a

A paper substrate having a basis weight of 80 g/m$^2$ was made by mixing, as raw pulp, 90 parts of LBKP and 10 parts of NBKP, beating the mixture, and then incorporating 10 parts of kaolin (product of Tsuchiya Kaolin Ind., Ltd.), 0.05 part of a neutral rosin size (Sizepine NT, trade name, product of Arakawa Chemical Industries, Ltd.) and 0.1 part of aluminum sulfate into the mixture in accordance with a method known per se in the art. The drying of the thus-made paper web was conducted by bringing it into contact under pressure with a stainless steel roll heated to 120° C. while it was in a wet state. The surface roughness of the smooth surface of the thus-obtained Paper Substrate a was measured by means of a surface structure measuring apparatus, SE-3H model (manufactured by Kosaka Laboratory). As a result, its $R_{max}$ value was 5.4 $\mu$m. The paper substrate had a Stöckigt sizing degree of 5 seconds.

Preparation of Paper Substrate b

A paper substrate having a basis weight of 72 g/m$^2$ was made by mixing, as raw pulp, 90 parts of LBKP and 10 parts of NBKP, beating the mixture, and then incorporating 10 parts of kaolin (product of Tsuchiya Kaolin Ind., Ltd.), 0.08 part of alkenylsuccinic anhydride and 0.2 part of cationized starch into the mixture in accordance with a method known per se in the art. The drying of the thus-made paper web was conducted in the same manner as in Paper Substrate a. The surface roughness of the smooth surface of the thus-obtained Paper Substrate b was measured in the same manner as in Paper Substrate a. As a result, its $R_{max}$ value was 9.8 $\mu$m. The paper substrate had a Stöckigt sizing degree of 12 seconds.

Preparation of Paper Substrate c

A base paper web having a basis weight of 83 g/m$^2$ was made by mixing, as raw pulp, 90 parts of LBKP and 10 parts of NBKP, beating the mixture, and then incorporating 15 parts of precipitated calcium carbonate (Escalon, trade name, product of Sankyo Seifun K.K.), 0.05 part of alkenylsuccinic anhydride and 0.1 part of cationized starch into the mixture in accordance with a method known per se in the art.

This base paper web was impregnated with an impregnating solution having the following composition so as to give a dry coating weight of 5 g/m$^2$, and then dried at 140° C. for 5 minutes, thereby obtaining Paper Substrate c. The paper substrate had a Stöckigt sizing degree of 14 seconds.

| Composition of impregnating solution: | (parts) |
|---|---|
| Hydroxyethylcellulose (HEC AL-15, trade name, product of Fuji Chemical Co., Ltd.) | 2 |
| Glyoxal | 0.8 |
| Water | 98. |

Preparation of Paper Substrates d and e

Paper Substrates d and e were obtained in the same manner as in Paper Substrate c except that impregnating solutions having the following respective compositions were used. The thus-obtained Paper Substrates d and e had Stöckigt sizing degrees of 11 seconds and 15 seconds, respectively.

| | (parts) |
|---|---|
| Composition of impregnating solution for Paper Substrate d: | |
| Hydroxypropylcellulose (Metholose 90SH-100, trade name, product of Shin-Etsu Chemical Co., Ltd.) | 2 |
| Blocked isocyanate (Elastoron BN-5, trade name, product of Dai-ichi Kogyo Seiyaku Co., Ltd.) | 0.2 |

-continued

| | (parts) |
|---|---|
| Organotin compound (Catalyst 64, trade name, product of Dai-ichi Kogyo Seiyaku Co., Ltd.) | 0.01 |
| Water | 98. |
| Composition of impregnating solution for Paper Substrate e: | |
| Carboxymethylcellulose (CMC-647, trade name, product of Sanyo-Kokusaku Pulp Co., Ltd.) | 2 |
| Glycerol diglycidyl ether (Denacol EX-313, trade name, product of Nagase Chemicals, Ltd.) | 0.5 |
| Zinc borofluoride | 0.01 |
| Water | 97. |

Preparation of Paper Substrate f

Paper Substrate f having a basis weight of 80 g/m$^2$ was made by mixing, as raw pulp, 60 parts of LBKP and 10 parts of NBKP and besides 30 parts of nylon fiber, beating the mixture, and then incorporating 10 parts of kaolin (product of Tsuchiya Kaolin Ind., Ltd.), 0.05 part of a neutral rosin size (Sizepine NT, trade name, product of Arakawa Chemical Industries, Ltd.) and 0.1 part of aluminum sulfate into the mixture in accordance with a method known per se in the art. The paper substrate had a Stöckigt sizing degree of 6 seconds.

Preparation of Paper Substrate g

Paper Substrate g having a basis weight of 72 g/m$^2$ was made by mixing, as raw pulp, 60 parts of LBKP and 10 parts of NBKP and besides 30 parts of polyester fiber, beating the mixture, and then incorporating 10 parts of kaolin (product of Tsuchiya Kaolin Ind., Ltd.), 0.06 part of alkenylsuccinic anhydride and 0.2 part of cationized starch into the mixture in accordance with a method known per se in the art. The paper substrate had a Stöckigt sizing degree of 10 seconds.

EXAMPLE 11

A coating formulation (1) for formation of a coating layer having a composition shown in Table 13 was applied onto the smooth surface of Paper Substrate a using a wire bar so as to give a dry coating weight of 10 g/m$^2$, and then dried at 100° C. for 5 minutes, thereby forming an ink-receiving layer.

TABLE 13

Composition of coating formulation (1)

| Component | Composition (parts) |
|---|---|
| Alumina (AKP-G030, trade name, product of Sumitomo Chemical Co., Ltd.) | 50 |
| Basic magnesium carbonate (product of Tokuyama Soda Co., Ltd.) | 50 |
| Polyvinyl alcohol (PVA-117, trade name, product of Kuraray Co., Ltd.) | 15 |
| Copolymer of monoallylamine/dimethylamine hydrochloride (PAA-D11-Hcl, trade name, product of Nitto Boseki Co., Ltd.) | 10 |
| Water | 975 |

A coating formulation (2) for formation of a coating layer having a composition shown in Table 14 was then applied onto the ink-receiving layer using a wire bar so as to give a dry coating weight of 5 g/m$^2$, and then dried by bringing the thus-formed coating film into contact under pressure with a stainless steel roll heated to 90° C. while the coating film was in a wet state, to form a surface layer, thereby preparing sheet-like Printing Media 11.

TABLE 14

Composition of coating formulation (2)

| Component | Composition (parts) |
|---|---|
| Ethylene-vinyl acetate copolymer resin (Flowback Q16079N, trade name, product of Seitetsu Kagaku Co., Ltd.) | 50 |
| Alumina Sol 520 (trade name, product of name, product of Nissan Chemical Industries, Ltd.) | 50 (solids) |
| Carboxymethylcellulose (Metholose 60SH, trade name, product of Shin-Etsu Chemical Co., Ltd.) | 25 |
| Calcium stearate | 5 |
| Water | 470 |

EXAMPLE 12

Sheet-like Printing Medium 12 was obtained in the same manner as in Example 11 except that the coating film obtained by the application of the coating formulation (2) was dried by hot air at 60° C. for 20 minutes and then treated by a supercalender heated to 80° C. to form a surface layer.

EXAMPLE 13

An ink-receiving layer and a surface layer were formed on the smooth surface of Paper Substrate b in the same manner as in Example 11, thereby preparing sheet-like Printing Medium 13.

EXAMPLE 14

An ink-receiving layer and a surface layer were formed on the smooth surface of Paper Substrate c in the same manner as in Example 11, thereby preparing sheet-like Printing Medium 14.

EXAMPLE 15

Sheet-like Printing Medium 15 was prepared in the same manner as in Example 14 except that the coating film obtained by the application of the coating formulation (2) was dried by hot air at 60° C. for 20 minutes and then treated by a supercalender heated to 80° C. to form a surface layer.

EXAMPLE 16

Sheet-like Printing Medium 16 was prepared in the same manner as in Example 11 except that Paper Substrate d was used.

EXAMPLE 17

Sheet-like Printing Medium 17 was prepared in the same manner as in Example 11 except that Paper Substrate e was used.

EXAMPLE 18

Sheet-like Printing Medium 18 was prepared in the same manner as in Example 11 except that Paper Substrate f was used.

EXAMPLE 19

Sheet-like Printing Medium 19 was prepared in the same manner as in Example 18 except that the coating film obtained by the application of the coating formulation (2) was dried by hot air at 60° C. for 20 minutes and then treated by a supercalender heated to 80° C. to form a surface layer.

EXAMPLE 20

Sheet-like Printing Medium 20 was prepared in the same manner as in Example 11 except that Paper Substrate g was used.

Using the same inks as those used in Example 7, color printing was conducted on the coated sides of the sheet-like Printing Media 11 to 20 obtained in Examples 11 to 20 under the following conditions by means of an ink-jet printing apparatus in which an ink is ejected by bubbling of the ink by thermal energy.

| Printing conditions: | |
|---|---|
| Ejection frequency: | 5 kHz |
| Volume of ejection droplet: | 40 pl |
| Printing density: | 360 DPI |
| Maximum printing density of a single color ink: | 8 nl/mm$^2$. |

The resulting color print samples were evaluated as to the following items.

[Evaluated Items for Examples 11 to 17]

(1) Optical density:

Optical densities of solid printed areas of black (Bk), cyan (C), Magenta (M) and yellow (Y) colors were separately measured by means of a Macbeth Densitometer RD-918.

(2) Image irregularity:

The image irregularity was evaluated by evenness of solid prints. More specifically, solid prints of black and blue colors (Cyan+Magenta) were visually observed, thereby ranking the image irregularity as A where no white spot irregularities were recognized on each solid print, or C where white spot irregularities were visually recognized even when observing the print 25 cm apart from the eyes.

(3) Surface glossiness:

With respect to each printing medium sample, the 75° and 20° specular glossinesses of the blank area of its coated surface were measured by means of a digital gonioglossmeter, UGV-5D (trade name, manufactured by SUGA TEST INSTRUMENTS CO., LTD.) in accordance with JIS Z 8741.

(4) Glossiness of print:

With respect to each printing medium sample, the 75° and 20° specular glossinesses of the solid printed areas of black (Bk), cyan (C), Magenta (M) and yellow (Y) colors were measured by means of a digital gonioglossmeter, UGV-5D (trade name, manufactured by SUGA TEST INSTRUMENTS CO., LTD.) in accordance with JIS Z 8741.

[Evaluated Items for Examples 18 to 20]

(1) Surface glossiness:

With respect to each printing medium sample, the 75° and 20° specular glossinesses of the blank area of its coated surface were measured by means of a digital gonioglossmeter, UGV-5D (trade name, manufactured by SUGA TEST INSTRUMENTS CO., LTD.) in accordance with JIS Z 8741.

(2) Glossiness of print:

With respect to each printing medium sample, glossinesses of mixed-color areas of red (R), green (G) and blue (Blu) colors in a solid print obtained by printing by means of the above-described printing apparatus were measured in the same manner as in the measurement of the surface glossiness (1).

The thus-obtained results of the evaluation are shown in Tables 15 and 16.

TABLE 15

| | Example | | | | | | |
|---|---|---|---|---|---|---|---|
| Evaluation item | 11 | 12 | 13 | 14 | 15 | 16 | 17 |
| Optical density | | | | | | | |
| Bk | 1.44 | 1.42 | 1.42 | 1.45 | 1.41 | 1.41 | 1.46 |
| C | 1.36 | 1.34 | 1.36 | 1.37 | 1.33 | 1.35 | 1.35 |
| M | 1.66 | 1.60 | 1.66 | 1.67 | 1.65 | 1.65 | 1.67 |
| Y | 1.26 | 1.22 | 1.24 | 1.27 | 1.21 | 1.23 | 1.38 |
| Image irregularity | A | A | A | A | A | A | A |
| Surface glossiness (%) (blank area) | | | | | | | |
| 75° | 85 | 83 | 85 | 85 | 83 | 85 | 83 |
| 20° | 35 | 35 | 35 | 35 | 35 | 35 | 33 |
| Glossiness of print (%) | | | | | | | |
| 75° | | | | | | | |
| Bk | 81 | 80 | 82 | 82 | 83 | 82 | 82 |
| C | 85 | 81 | 85 | 84 | 85 | 86 | 82 |
| M | 83 | 83 | 82 | 82 | 84 | 83 | 82 |
| Y | 81 | 81 | 80 | 82 | 83 | 81 | 82 |
| 20° | | | | | | | |
| Bk | 23 | 22 | 23 | 23 | 23 | 23 | 23 |
| C | 27 | 25 | 26 | 26 | 26 | 25 | 25 |
| M | 23 | 23 | 22 | 24 | 22 | 23 | 22 |
| Y | 24 | 23 | 24 | 25 | 23 | 24 | 23 |

TABLE 16

| Evaluation item | | | Example 18 | 19 | 20 |
|---|---|---|---|---|---|
| Surface glossiness (%) (blank area) | | 75° | 76 | 76 | 76 |
| | | 20° | 26 | 26 | 26 |
| Glossiness of print (%) | 75° | R | 74 | 74 | 73 |
| | | G | 73 | 74 | 74 |
| | | Blu | 73 | 74 | 74 |
| | 20° | R | 24 | 24 | 23 |
| | | G | 24 | 23 | 23 |
| | | Blu | 23 | 23 | 23 |

As apparent from Examples 11 to 20, the printing media according to the present invention do not cause waves and distortions, which are caused by the swelling due to the absorption of the solvent components of inks into the paper substrate, on the surfaces of their paper substrates even at printed areas after printing, and can hence retain good surface glossiness, so that printed images exhibiting high glossiness and resolution and good coloring to an extent comparable to a silver salt photograph can be obtained when ink-jet printing is performed on these printing media.

While the present invention has been described with respect to what is presently considered to be the preferred embodiments, it is to be understood that the invention is not limited to the disclosed embodiments. To the contrary, the invention is intended to cover various modifications and equivalent arrangements include within the sprint and scope of the appended claims. The scope of the following claims is to be accorded to the broadcast interpretation so as to encompass all such modifications and equivalent structures and functions.

What is claimed is:

1. A printing medium, comprising a liquid-absorbent base material, an ink-receiving layer provided on the base material, which comprises a pigment, a binder and a cationic substance, and a surface layer of cationic ultrafine inorganic particles having a particle diameter ranging from 1 nm to 500 nm, said particles being particles of aluminum hydrate, or particles of silica the surface of which has been cationized with an organic substance, provided on the ink-receiving layer, the surface layer having a 75° specular glossiness of 45% or higher, wherein the cationic substance is contained in the ink-receiving layer in a range of 0.01 to 7 g/m$^2$, and the liquid-absorbent base material has a Stöckigt sizing degree in a range of 0 to 15 seconds.

2. The printing medium according to claim 1, wherein the surface layer comprises the cationic ultrafine particles and a binder in a weight ratio ranging from 50:1 to 1:2.

3. The printing medium according to claim 1, wherein the surface layer comprises fine particles of an organic resin in a proportion of up to 100 parts by weight per 100 parts by weight of the cationic ultrafine particles.

4. The printing medium according to claim 3, wherein the particle diameter of the fine particles of the organic resin falls within a range of from 0.01 $\mu$m to 5 $\mu$m.

5. The printing medium according to claim 1, wherein the pigment is selected from the group consisting of silica, alumina, alumina hydrate and basic magnesium carbonate.

6. The printing medium according to claim 1, wherein the mixing ratio by weight of the pigment to the binder falls within the range of from 10:1 to 1:2.

7. The printing medium according to claim 1, wherein the cationic substance is selected from the group consisting of polyallylamine, hydrochlorides thereof, polyamine sulfone, hydrochlorides thereof, polyvinylamine, hydrochlorides thereof and chitosan or an acetate thereof.

8. The printing medium according to claim 1, wherein the cationic substance is a polymer of a monomer selected from the group consisting of dimethylaminoethyl acrylate, dimethylaminoethyl methacrylate, diethylaminoethyl acrylate, diethylaminoethyl methacrylate, methylethylaminoethyl acrylate, methylethylaminoethyl methacrylate, dimethylaminostyrene, diethylaminostyrene and methylethylaminostyrene.

9. The printing medium according to claim 1, wherein the cationic substance is selected from copolymers of vinylpyrrolidone with a quaternary salt of an aminoalkyl acrylate and copolymers of acrylamide with a quaternary salt of aminomethylacrylamide.

10. The printing medium according to claim 1, wherein the base material is paper.

11. The printing medium according to claim 1, wherein the base material has a basis weight ranging from 50 to 200 g/m$^2$.

12. The printing medium according to claim 1, wherein the surface roughness of the base material is 15 $\mu$m or smaller.

13. An ink-jet printing process comprising ejecting droplets of inks from ejection orifices of a printing head in response to printing signals to apply the ink droplets to the printing medium according to any one of claims 1–12.

14. The ink-jet printing process according to claim 13, wherein the inks each contain an anionic coloring material.

15. The ink-jet printing process according to claim 13, wherein the inks to be applied are cyan, magenta, yellow and black inks.

16. The ink-jet printing process according to claim 15, wherein a printing head having at least two ejection orifices for ejecting each of the inks is used to eject two or more ink droplets of the same color at substantially the same time, thereby forming an image.

17. The ink-jet printing process according to claim 13, wherein thermal energy is applied to the inks to eject the inks.

18. An image-forming process comprising ejecting droplets of inks from ejection orifices of a printing head in response to printing signals to apply the ink droplets to the printing medium according to any one of claims 1–12.

19. The image-forming process according to claim 18, wherein the inks each contain an anionic coloring material.

20. The image-forming process according to claim 18, wherein the inks to be applied are cyan, magenta, yellow and black inks.

21. The image-forming process according to claim 20, wherein a printing head having at least two ejection orifices for ejecting each of the inks is used to eject two or more ink droplets of the same color at substantially the same time, thereby forming an image.

22. The image-forming process according to claim 18, wherein an ink-jet system is used to eject the ink droplets.

23. The image-forming process according to claim 22, wherein the ink-jet system is a system in which thermal energy is applied to an ink to eject droplets of the ink.

24. A printing medium, comprising a liquid-absorbent paper substrate, which substrate comprises fibrous pulp and a filler and is made nonswelling, an ink-receiving layer provided on the paper substrate, which comprises a pigment, a binder and a cationic substance, and a surface layer of cationic ultrafine inorganic particles having a particle diameter ranging from 1 nm to 500 nm, said particles being particles of aluminum hydrate, or particles of silica the surface of which has been cationized with an organic substance, provided on the ink-receiving layer, the surface layer having a 75° specular glossiness of 45% or higher, wherein the cationic substance is contained in the ink-receiving layer in a range of 0.01 to 7 g/m$^2$, and the liquid-absorbent paper substrate has a Stöckigt sizing degree in a range of 0 to 15 seconds.

25. The printing medium according to claim 24, wherein the surface layer comprises the cationic ultrafine particles and a binder in a weight ratio ranging from 50:1 to 1:2.

26. The printing medium according to claim 24, wherein the surface layer comprises fine particles of an organic resin in a proportion of up to 100 parts by weight per 100 parts by weight of the cationic ultrafine particles.

27. The printing medium according to claim 26, wherein the particle diameter of the fine particles of the organic resin falls within a range of from 0.01 $\mu$m to 5 $\mu$m.

28. The printing medium according to claim 24, wherein the pigment is selected from the group consisting of silica, alumina, alumina hydrate and basic magnesium carbonate.

29. The printing medium according to claim 24, wherein the mixing ratio by weight of the pigment to the binder falls within a range of from 10:1 to 1:2.

30. The printing medium according to claim 24, wherein the cationic substance is selected from the group consisting of polyallylamine, hydrochlorides thereof, polyamine sulfone, hydrochlorides thereof, polyvinylamine, hydrochlorides thereof and chitosan or an acetate thereof.

31. The printing medium according to claim 24, wherein the cationic substance is a polymer of a monomer selected from the group consisting of dimethylaminoethyl acrylate, dimethylaminoethyl methacrylate, diethylaminoethyl acrylate, diethylaminoethyl methacrylate, methylethylaminoethyl acrylate, methylethylaminoethyl methacrylate, dimethylaminostyrene, diethylaminostyrene and methylethylaminostyrene.

32. The printing medium according to claim 24, wherein the cationic substance is selected from copolymers of vinylpyrrolidone with a quaternary salt of an aminoalkyl acrylate and copolymers of acrylamide with a quaternary salt of aminomethylacrylamide.

33. The printing medium according to claim 24, wherein the paper substrate has a basis weight ranging from 50 to 200 $g/m^2$.

34. The printing medium according to claim 24, wherein the paper substrate has been made nonswelling by impregnating base paper comprising fibrous pulp and a filler with a crosslinking substance, and crosslinking the crosslinking substance.

35. The printing medium according to claim 34, wherein the crosslinking substance is a polymer having a reactive group.

36. The printing medium according to claim 34, wherein a crosslinking agent is used for crosslinking the crosslinking substance.

37. The printing medium according to claim 36, wherein the compounding ratio by weight of the crosslinking substance to the crosslinking agent falls within a range of from 100:1 to 1:1.

38. The printing medium according to claim 24, which has been made nonswelling by mixing nonswelling fibers into the paper substrate.

39. The printing medium according to claim 38, wherein the nonswelling fiber is glass fiber or fiber made of a hydrophobic resin.

40. The printing medium according to claim 38, wherein the mixing ratio by weight of the fibrous pulp to the nonswelling fiber falls within a range of from 9:1 to 5:5.

41. An ink-jet printing process comprising ejecting droplets of inks from ejection orifices of a printing head in response to printing signals to apply the ink droplets to the printing medium according to any one of claims 24–40.

42. The ink-jet printing process according to claim 41, wherein the inks each contain an anionic coloring material.

43. The ink-jet printing process according to claim 41, wherein the inks to be applied are cyan, magenta, yellow and black inks.

44. The ink-jet printing process according to claim 43, wherein a printing head having at least two ejection orifices for ejecting each of the inks is used to eject two or more ink droplets of the same color at substantially the same time, thereby forming an image.

45. The ink-jet printing process according to claim 41, wherein thermal energy is applied to the inks to eject the inks.

46. An image-forming process comprising ejecting droplets of inks from ejection orifices of a printing head in response to printing signals to apply the ink droplets to the printing medium according to any one of claims 24–40.

47. The image-forming process according to claim 46, wherein the inks each contain an anionic coloring material.

48. The image-forming process according to claim 46, wherein the inks to be applied are cyan, magenta, yellow and black inks.

49. The image-forming process according to claim 48, wherein a printing head having at least two ejection orifices for ejecting each of the inks is used to eject two or more ink droplets of the same color at substantially the same time, thereby forming an image.

50. The image-forming process according to claim 46, wherein an ink-jet system is used to eject the ink droplets.

51. The image-forming process according to claim 50, wherein the ink-jet system is a system in which thermal energy is applied to an ink to eject droplets of the ink.

* * * * *

UNITED STATES PATENT AND TRADEMARK OFFICE

CERTIFICATE OF CORRECTION

PATENT NO. : 6,203,899 B1
DATED : March 20, 2001
INVENTOR(S) : Hirose et al.

It is certified that error appears in the above-identified patent and that said Letters Patent is hereby corrected as shown below:

Column 1,
Line 45, “dried);” should read -- dried; --.

Column 7,
Line 9, “singly-” should read -- single- --.

Column 12,
Line 44, “he” should read -- the --.

Column 17,
Table 8, line 55, “Nissin Chemical Industry Co.,” should read -- Nissan Chemical Industries, --.

Signed and Sealed this

Twenty-eighth Day of January, 2003

JAMES E. ROGAN
*Director of the United States Patent and Trademark Office*